US008307474B2

(12) United States Patent
Sandland et al.

(10) Patent No.: US 8,307,474 B2
(45) Date of Patent: Nov. 13, 2012

(54) TRANSFER TROLLEY

(75) Inventors: Steven Sandland, Essex (GB); Patrick Finlay, Bucks (GB)

(73) Assignee: Personal Lifting, Ltd., Harlow, Essex (GB)

( * ) Notice: Subject to any disclaimer, the term of this patent is extended or adjusted under 35 U.S.C. 154(b) by 605 days.

(21) Appl. No.: 12/519,125

(22) PCT Filed: Dec. 11, 2007

(86) PCT No.: PCT/GB2007/004741
§ 371 (c)(1),
(2), (4) Date: Jan. 19, 2010

(87) PCT Pub. No.: WO2008/071940
PCT Pub. Date: Jun. 19, 2008

(65) Prior Publication Data

US 2010/0138989 A1 Jun. 10, 2010

(30) Foreign Application Priority Data

Dec. 15, 2006 (GB) ..... 0625097.1

(51) Int. Cl.
*A61G 7/10* (2006.01)

(52) U.S. Cl. ..... 5/83.1; 5/86.1

(58) Field of Classification Search ..... 5/83.1, 5/86.1, 89.1, 613
See application file for complete search history.

(56) References Cited

U.S. PATENT DOCUMENTS

| | | | | |
|---|---|---|---|---|
| 1,857,031 | A * | 5/1932 | Schaffer | 5/86.1 |
| 3,178,732 | A | 4/1965 | Stibitz | |
| 3,757,788 | A | 9/1973 | Renfroe | |
| 4,084,275 | A | 4/1978 | Ilon | |
| 5,323,498 | A * | 6/1994 | Fellay et al. | 5/86.1 |
| 5,428,851 | A | 7/1995 | Shore et al. | |
| 6,994,112 | B2 | 2/2006 | Garman et al. | |
| 7,568,240 | B2 * | 8/2009 | Palay et al. | 5/81.1 R |
| 7,818,831 | B2 * | 10/2010 | Mahdjoubi | 5/81.1 R |
| 2007/0295339 | A1 | 12/2007 | Mizuno et al. | |
| 2008/0022456 | A1 | 1/2008 | Patterson et al. | |
| 2008/0210917 | A1 | 9/2008 | Niklasson | |

FOREIGN PATENT DOCUMENTS

| | | |
|---|---|---|
| DE | 21 2004 000 040 U1 | 6/2006 |
| ES | 2 117 909 | 5/1994 |
| GB | 1 270 150 | 4/1972 |
| NL | 9101806 | 5/1993 |
| SE | 529 429 C2 | 5/2007 |
| WO | WO 91/07158 | 5/1991 |
| WO | WO 94/27548 | 12/1994 |
| WO | WO 2005/013876 A1 | 2/2005 |
| WO | WO 2007/050016 A1 | 5/2007 |

* cited by examiner

*Primary Examiner* — Fredrick Conley

(74) *Attorney, Agent, or Firm* — Jon M. Gibbs; Lowndes, Drosdick, Doster, Kantor & Reed, P.A.

(57) ABSTRACT

A lifting element for use with a transfer trolley, the element comprising: a support member having a support surface and a sheath attached to the support member such that, in an initial configuration, a first portion of the support surface is covered by the sheath and a second portion thereof is uncovered, wherein the sheath is operable to be inflated so as to cause the sheath to extend and evert, insinuating itself under a load in order to support the load, and, after inflation, the support member and the sheath may be moved with respect to each other so that the support member extends further into the sheath, the second portion of the support surface is covered by the sheath and the support surface at least partially supports the load.

19 Claims, 7 Drawing Sheets

TRANSFER TROLLEY

CROSS REFERENCE TO RELATED APPLICATIONS

This application claims priority to PCT Application PCT/GB/2007/004741, filed Dec. 11, 2007, which claims priority to GB Patent Application GB 0625097.1 filed Dec. 15, 2006.

FIELD OF THE INVENTION

The present invention relates to a transfer trolley and, more particularly, aspects of the invention relate to a transfer trolley that can be used to lift a load and transfer it to a new location. Specifically, transfer trolleys according to embodiments of the present invention can be used to lift medical patients from a bed or table for transfer to another location.

Although embodiments of the invention will be described below in relation to the transfer of medical patients, it would be appreciated that embodiments of the invention can be utilised to transport and transfer other loads, such as delicate items, comprising china, ceramics, explosives, aerospace components or radioactive material. A trolley in accordance with aspects of the present invention can also be used to move motor vehicles, such as illegally parked vehicles.

BACKGROUND OF THE INVENTION

At present there are a large number of bed-ridden people around the world. It is envisaged that as the life expectancy of people increases, due to advances made in the fields of medicine and other types of healthcare, the number of bed-ridden people may increase.

Many nurses and hospital staff are injured when attempting to lift bed-ridden patients from their beds. In particular, despite rigorous training for lifting heavy objects, workers such as nurses often find it necessary to adopt postures which are awkward in order to lift heavy objects such as patients. Thus, many nurses suffer from back injuries as a result of lifting patients or transferring patients from one bed to another.

In addition, some patients, for example patients with severe burns, require extremely delicate and careful handling during bed transfers. This applies equally to patients leaving an operating theatre, such as a heart by-pass patient. In some instances, a rigid backboard is forced beneath the patient so that the patient can be lifted from one bed to another following an operation or injury. Forcing a backboard under a patient with severe burns can damage the already delicate wounds and increase the likelihood of infection. Furthermore, the force and nature of the movements necessary to insert a backboard under a patient are such that the patient is often subjected to comparatively "rough treatment."

Various attempts have been made to provide a patient transfer trolley adapted to lift a patient from a bed and transport the patient. One such example can be found in international patent publication no. WO91/07158. A transfer trolley according to this document comprises an arm from which a number of rigid tongues extend. The rigid tongues generally form a bed-like surface and are capable of supporting a patient. The tongues are hollow and could be described as flatted tube-like structures; a hole is located at the free end of each tongue (i.e. the end not connected to the arm). Each of the tongues is covered in a resilient sleeve or sheath and contains a plunger within the hollow cavity.

The sheath is longer than the tongue which it surrounds and the excess material is inserted into the hollow cavity of the tube (where there is a connection between the sheath and the plunger) and also accommodated by a concertina arrangement of part of the sheath on the outside of the tongue.

A wedge shaped block separates the concertina arrangement on the top surface of the tongue from the rest of the sheath.

When it is decided that a patient is to be transferred from a bed, the transfer trolley according to WO91/07158 is manoeuvred into a position next to and parallel with the patient's bed. Compressed air is introduced into the sheaths and this action drives the portion of the sheath contained within the hollow cavity of the tongue outwards through the hole in the free end of the tongue.

As the sheath is attached to the plunger in each respective tongue, a cylinder of sheath inflates and unfurls in a direction away from the trolley and underneath the patient. Once the patient is supported on the inflated cylinder, the trolley is moved towards the patient's bed; thus the wedge shaped section (which remains stationary relative to the patient) is now closer to the arm and this has the effect of pulling the sheaths, with the patient supported thereon, towards the arm so that the portions of the sheaths that support the patient slide over the respective tongues. The weight of the patient is now supported by the tongues and not by the inflated sheath.

To place the patient on a new bed, the operation is generally reversed.

There are a number of problems which have been experienced with the device disclosed in WO91/07158, particularly when operated by personnel unfamiliar with the operations, which include the poor operation of the concertina section of the sleeve, poor control of the section of the sleeve at the interface of the smooth section and the concertina section.

The present invention seeks to ameliorate at least some of the problems associated with the prior art.

SUMMARY OF THE INVENTION

Accordingly an aspect to the present invention provides a lifting element for use with a transfer trolley, the element comprising: a support member having a support surface and a sheath attached to the support member such that, in an initial configuration, a first portion of the support surface is covered by the sheath and a second portion thereof is uncovered, wherein the sheath is operable to be inflated so as to cause the sheath to extend and evert, insinuating itself under a load in order to support the load, and, after inflation, the support member and the sheath may be moved with respect to each other so that the support member extends further into the sheath, the second portion of the support surface is covered by the sheath and the support surface at least partially supports the load.

Preferably, the sheath is fixedly attached to the main body section.

Alternatively, the sheath is attached to the main body section by a sliding seal attachment arrangement.

Preferably, the support member has a distal end and a proximal end; the sheath is attached to the support member at a securing location which is separated from the proximal end of the member; and, after inflation, the support member and sleeve may be moved with respect to each other so that a portion of the sleeve covers at least a part of the region of the support surface between the securing location and the proximal end of the support member.

Alternatively, the support member has a distal end and a proximal end; the sheath is attached to the support member by a sliding seal which is provided between the proximal and distal ends thereof and operable to slide along at least a part of the length of the member; and, after inflation, the sliding seal is operable to slide towards the proximal end of the member to allow the load to be at least partially supported by the support member.

Preferably the lifting element further comprises a fluid channel to inflate the sheath.

Advantageously, the fluid channel is provided within the support element.

Conveniently, the lifting element further comprises a drawstring attached to the sheath and operable to control an aspect of the inflation or deflation of the sheath.

Another aspect of the present invention provides a transfer trolley including one or more lifting elements.

Advantageously, the lifting elements are provided in spaced apart relation to provide an array on which a patient may be placed.

Preferably, the transfer trolley further comprises an arrangement for selectively controlling the one or more lifting elements.

Conveniently, the transfer trolley further comprises a base arrangement including a track and a tower mounted on the track operable to support the one or more lifting elements, wherein the one or more lifting elements can be moved with respect to the base arrangement by moving the tower along the track.

Advantageously, the lifting elements are supported by one or more arms.

Preferably, the lifting elements are supported by a plurality of arms.

Conveniently, two or more of the plurality of arms are attached to each other by joints.

Preferably, the arms are operable to be moved with respect to each other.

Advantageously, the transfer trolley further comprises an angle adjustment arrangement operable to adjust the angle of the lifting elements with respect to a horizontal plane.

Preferably, the lifting elements may be rotated with respect to each other.

Another aspect of the present invention provides a method of lifting a load utilizing a lifting element having a sheath and a support member comprising the steps of: inflating the sheath causing the sheath to insinuate under the load, and moving the sheath and the support member with respect to each other so that the support member extends into the sheath and the support member at least partially supports the load.

Another aspect of the present invention provides a transfer trolley comprising a two or more arms each supporting one or more lifting elements, each element comprising a support member and a sheath attached to the support member and operable to be inflated so as to cause the sheath to extend and evert, insinuating itself under a load in order to support a load, wherein the arms are suitable to be moved with respect to each other from a first configuration to a second configuration.

Preferably, the arms are operable to be moved from a first configuration to a second configuration in which the arms are at different angles with respect to each other.

In order that the present invention may be more readily understood, and so that further features thereof may be appreciated, the invention will now be described, by way of example, with reference to the accompanying drawings in which:

DETAILED DESCRIPTION OF THE INVENTION

Figure 1:
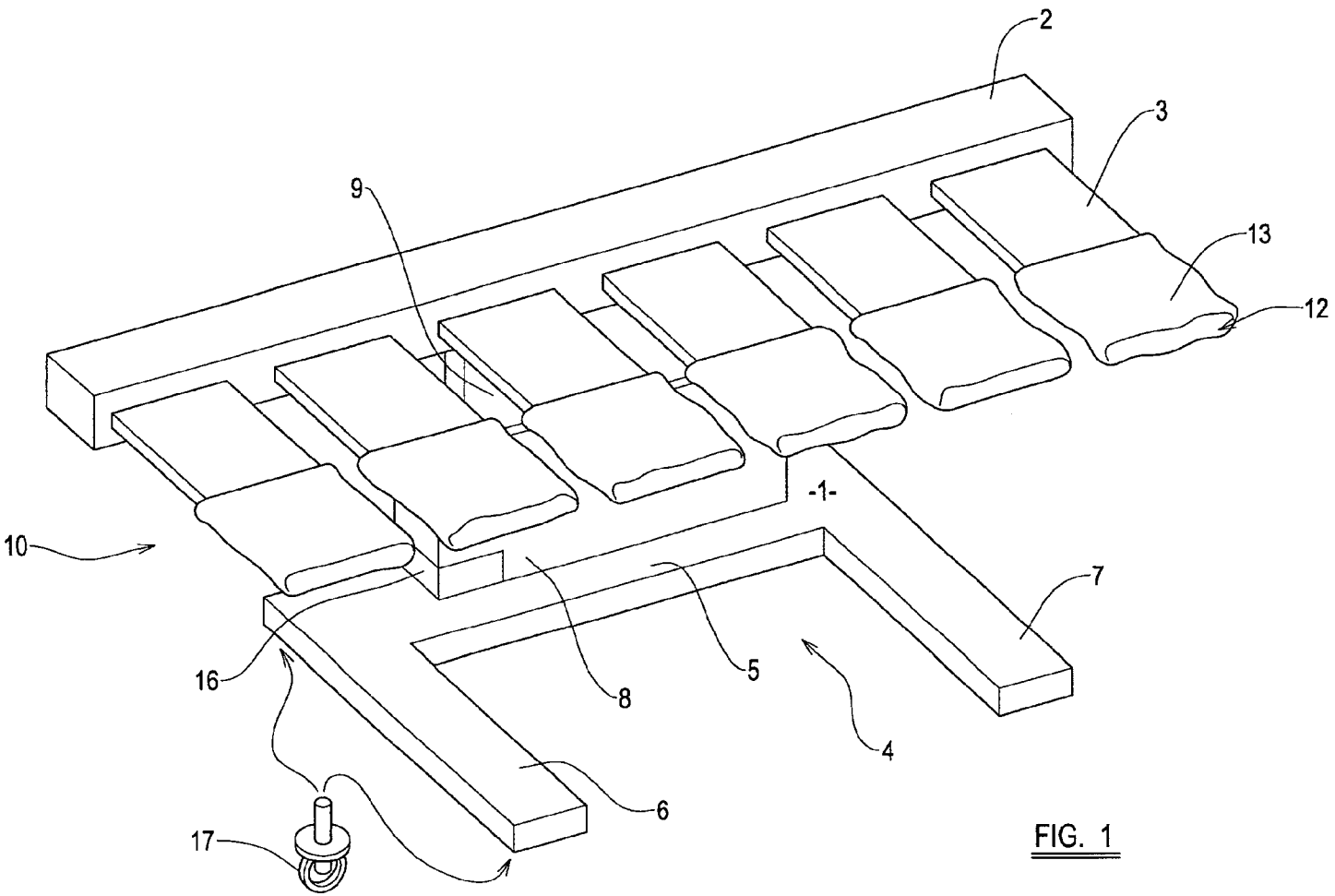
FIG. 1 shows a transfer trolley in accordance with an embodiment of the present invention.

A transfer trolley 10 according to an embodiment of the present invention includes a frame 1. One example form that the frame 1 may take is shown in FIG. 1. In this example the frame 1 comprises a c-shaped base 4. The c-shaped base 4 has a horizontal main beam 5 with a longitudinal axis and two laterally extending horizontal support beams 6,7—one at either end of the main beam 5 and both extending in a first direction perpendicular to the longitudinal axis thereof.

The base 4 is typically mounted on four or more wheels or casters 17 to allow for movement of the transfer trolley 10. The wheels or casters 17 are preferably provided with locks that can be activated once the transfer trolley 10 is in a desired location to prevent any further and unwanted movement. The exact type of wheels or casters 17 utilised will be apparent to a skilled person depending upon the degree and type of movement required for the specific task at hand. In some embodiments of the present invention the base 4 is attached to wheels suitable to run on rails.

A vertical tower 8 extends from the main beam 5 to a height which is generally less than the height of a hospital bed or table. The tower 8 holds a turret 9 telescopically mounted at an upper end of the tower 8, and the height to which the turret 9 extends above the top of the tower 8 (ie. the height of a free end of the turret 9 above the tower 8) can be controlled, for example, hydraulically—although other mounting mechanisms are also envisaged. Thus, as will shortly be explained, the trolley 10 can be adjusted to accommodate a number of different bed or table heights.

In some embodiments of the present invention the base 4 further comprises a track arrangement (not shown) on which the tower 8 is mounted. The tower 8 may, therefore, be moved along the track relative to the position of the base 4. Preferably, the track arrangement allows the tower 8 to be moved in a direction parallel to the horizontal support beams 6,7 of the base 4.

An arm 2 is attached, in a substantially horizontal orientation, to the free upper end of the turret 9 and has a longitudinal axis which is substantially parallel to the longitudinal axis of the main beam 5 of the base 4. In some embodiments of the present invention the arm 2 is supported by one or more rigid support beams (not shown) which are attached to both the arm 2 and the turret 9 and help to support the arm 2 in a generally fixed position relative to the turret 9.

A plurality of spaced apart tongues, projections, or tines 3 (ie. support members) extend from the arm 2 in the first direction and have longitudinal axes which are generally perpendicular to the longitudinal axis of the arm 2. The tongues 3 each have an upper support surface and form a slatted transfer shelf, and are securely attached to the arm 2 at one end thereof (ie. a proximal end) such that they are suitable to support the weight of a patient lying across the tongues 3. In other words, the tongues 3 form a cantilevered transfer shelf.

Ideally, the transfer trolley 10 is sufficiently strong to ensure that a patient of a mass up to about 150 Kg can be supported on the transfer shelf. Preferably, the transfer shelf of the trolley 10 can support masses of over about 150 Kg.

Each tongue 3 has a hollow cavity 11 extending along the length thereof, the cavity 11 having an opening at both the free end 12 (ie. the distal end) and the end attached to the arm 2 (ie. the proximal end). Therefore, each tongue 3 takes the general appearance of a flattened pipe or, indeed, may comprise a substantially cylindrical pipe.

Figure 2:
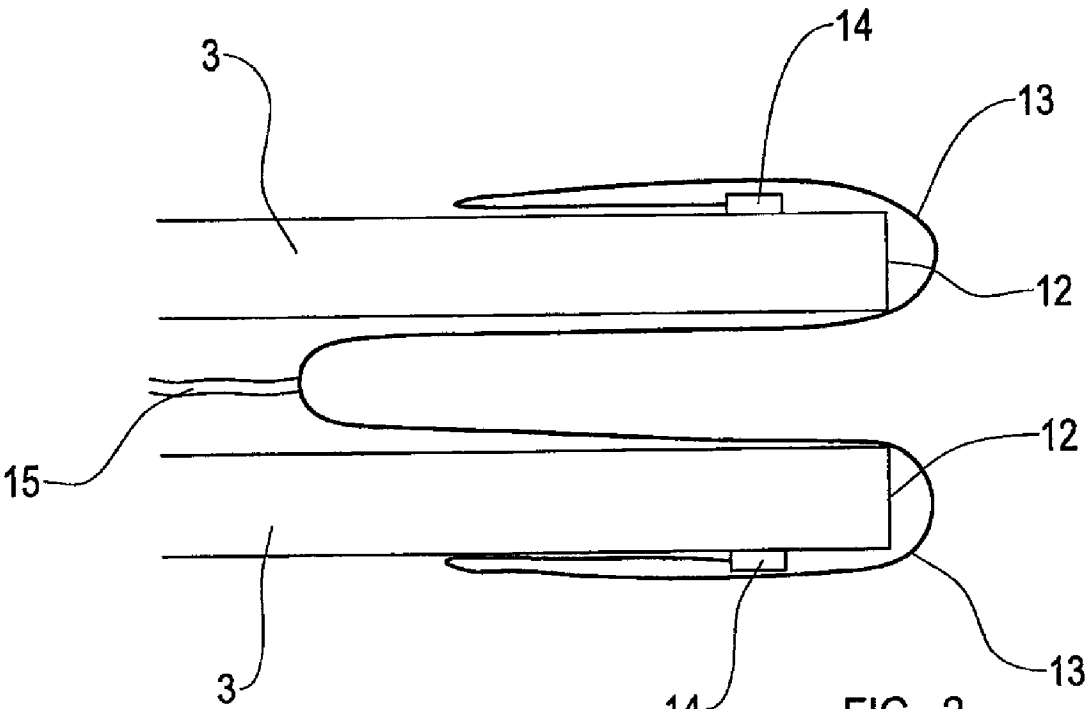
FIG. 2 shows a cross-sectional view of one of the tongues of the an embodiment of the present invention.

As can be seen in FIG. 2, respective sheaths 13 of flexible material are securely attached to each tongue 3 using a securing mechanism 14. The securing mechanism 14 can take a number of different forms but preferably the mechanism comprises a crimping ring or band 14 which is placed around a portion of the sheath 13 and the tongue 3 and subsequently compressed—securing the sheath 13 to the tongue 3. A seal is created at the crimping ring 14 (or other securing mechanism) which ensures that there is a substantially airtight seal which prevents any air (or liquid or other fluid) which is pumped into the sheath 13 through the tongue 3 from escaping from the sheath 13 and tongue 3 at the point at which they are secured to one another. Preferably, the securing mechanisms 14 are, when fitted, separated from the proximal ends of each tongue 3, and more preferably are located towards the free ends of each tongue 3. It is envisaged that any suitable securing mechanism 14 may be utilised including but not limited to wire clamps, spring clamps, adhesive bonding, and screw clamps.

Alternatively, embodiments of the present invention include arrangements where there is a moveable or sliding seal 18 attached to an open end of each sheath 13 and operable to slide or move along a respective tongue 3. During the sliding operation the seal is generally maintained. The sliding seal 18 can take any number of different forms which will be apparent to a person skilled in the art. For example, one or more rubber skirts (not shown) could be used either side of a cavity in an annular sealing mechanism 18, the cavity contains a plurality of lubricated balls (not shown). The lubricated balls maintain a generally fixed distance between the sealing mechanism 18 and a surface of the tongue 3; the rubber skirts ensure that there is an adequate seal between the sealing mechanism 18 and the tongue 3. Preferably at least one of the rubber skirts is biased such that pressure applied to the skirt by, for example, a hydraulic fluid, presses the skirt against the tongue 3 and ensures that a seal is maintained. Of course, other materials could be used to form the skirts, not just rubber (for example, synthetic rubber materials, or plastics). This arrangement can be seen in FIG. 3*a*.

Each sheath 13 is preferably in the form of a sock of flexible and strong, substantially airtight material and in an initial configuration is preferably doubled back on itself along an outer surface of its respective tongue 3 towards the proximal end of the tongue 3 (i.e. the end which is secured to the arm 2). In other words, each sheath 13 may extend from the seal 14 towards the arm 2 along the outer surface of the tongue 3 to which it is attached. At a point along the length of the tongue 3, the sheath 13 is folded such that it extends back towards the distal (i.e. free) end of the tongue 3, over the part of the sheath 13 that is nearest the seal 14, and is closed over the distal end of the tongue 3.

The sheaths 13 are sufficiently long to ensure that nearly the entire of each respective tongue 3 can be covered by the sheath 13 in the doubled back arrangement described above. However, in the initial configuration, the sheaths 13 do not cover substantially all of their respective tongues 3 and a first portion of the support surface is covered by the sheath 13 while the remainder thereof is not covered. Excess sheath material is contained within the hollow cavity 11 of the tongue 3 (where this excess material has been drawn in through the holes in the free ends of the tongues 3). This first configuration can be seen in FIG. 2.

Each sheath 13 has a cross-sectioned width of a size which is suitable to allow the sheath 13 to be slid onto a tongue 3. Preferably, the sheaths 13 are of a suitable size to allow the sheaths 13 to be tightly fitted to the tongues 3.

Each sheath 13 and tongue 3 form a respective lifting element attached to the arm 2.

The arm 2 also has a hollow cavity (not shown) running along the length thereof which is in fluid communication the hollow cavity 11 in each of the tongues 3 attached thereto.

In some embodiments of the present invention there is a motor (not shown) within the hollow cavity 11 of each tongue. Alternatively, motors (not shown) for each respective tongue 3 may be located within the hollow cavity of the arm 2. The motors are operable to drive spools (not shown) associated with each of the tongues 3. The spools each operate a drawstring 15, one end of which is secured to the spool and the other end of which is attached to a portion of the respective sheath 13—preferably at the tip of the sheath 13. In some embodiments there are spools within the hollow cavity of the arm 2 associated with each tongue 3. All of the spools, in this embodiment, may be driven by a single motor (not shown) which may be located in the hollow cavity of the arm 2 or in another part of the transfer trolley 10.

In further embodiments a plunger (not shown) is located with the hollow cavity 11 of each tongue 3. One end of a drawstring 15 is attached to the plunger and the other end is attached to the sheath 13. Preferably, the plunger does not have a tight fit in the hollow cavity 11 of the tongue 3 and, thus, allows air to pass around it and into the sheath 13. Alternatively, one or more holes may be formed through the plunger to allow air to pass therethrough.

The hollow cavity of the arm 2 is connected to a compressor 16 which is operable to force air (or another fluid, which may be a liquid) into the hollow cavity of the arm and into the hollow cavities of the tongues 3 connected thereto. Thus, it will be appreciated that the sheath 13 on each of the tongues 3 may be inflated. Similarly, the compressor 16 may force air (or another fluid) out of the arm 2 and, consequently, out of the tongues (or a release valve may be opened to allow the air in the sheath 13 to be released to, for example, the atmosphere or an air reservoir)—thus, deflating the sheaths 13.

The compressor 16 is preferably attached to the trolley 10 and could, for example be mounted on or next to the tower 8.

In some embodiments the arm 2 does not have a hollow cavity and the compressor is connected directly to the tongues 3 through one or more pipes.

It will be understood that the sheaths 13 should be made out of a material which is substantially airtight. The sheaths could comprise multiple layers including an airtight (or substantially airtight) inner layer, and an outer layer. Preferably, the outer layer comprises a number of sublayers; for example, an innermost sublayer could be a durable layer designed to prevent damage to the inner layer, the next innermost sublayer could comprise a removable layer which can be sterilised between uses or could be disposable.

It is envisaged that the sheaths 13 should be constructed out of a flexible material or materials. The sheaths 13 could, for example, be constructed out of a rubber-like material. Preferably the sheaths 13 are constructed out of polyurethane coated nylon.

In some embodiments of the present invention the trolley 10 also includes an arrangement (not shown) suitable to adjust the angle of the tongues 3 with respect to the horizontal (the tongues 3 preferably normally being substantially horizontal). This angle adjustment arrangement preferably comprises one or more hydraulic jacks. The angle adjustment arrangement may comprise a separate arrangement for each tongue 3 so that they can be operated independently. Alternatively, the angle adjustment arrangement could comprise an arrangement for two or more tongues 3 so that they can be operated in groups. Alternatively, the angle adjustment arrangement could comprise a single arrangement for all the tongues 3 so that they can be operated in unison. Of course, even if there is not a single arrangement for all of the tongues 3, the arrangements may still be operated in unison or substantially in unison. It will be appreciated that in the embodiments mentioned above, the angle adjustment arrangement may control the orientation of the tongues 3 with respect to the arm 2, or the arm 2 with respect to the base 4.

Embodiments of the present invention which include an angle adjustment arrangement are advantageous in situations in which the object (or patient 21) which is to be lifted is partially recessed into the surface from which it is to be lifted—for example, a patient on a soft mattress. Under these circumstances the angle adjustment arrangement can be utilised to adjust the angle of the tongues 3 from the horizontal to allow the sheaths 13 to inflate into mattress and under the patient 21. Once the patient 21 has been lifted, the tongues 3 may be returned to a substantially horizontal angle.

In some embodiments of the present invention the arm 2 includes a number of sections attached to the neighbouring sections by hinges (not shown). Preferably the arm 2 has two hinges and, thus, three sections. The sections generally comprising a leg support section, a seat section and a back support section. The hinges may be activated hydraulically or electrically. Thus, when, for example, a patient 21 is supported by the transfer trolley 10 the sections of the arm 2 may be moved with respect to each other from a first to a second configuration in order to adjust the arrangement of the patient 21—for example from a lying to a sitting arrangement. Consequently, a patient can be transferred from a bed to, for example, a chair or wheel chair. It will be appreciated that the same result can be achieved by the use of, for example, tongues 3 mounted on a plurality of separate arms 2, the orientations or positions of which may be controlled—for example, the trolley 10 could include three arms 2 each with one or more respective tongues 3.

It will be appreciated that the hinges could be replaced by any other type of similar joint. These joints could allow different degrees of movement in multiple axes. Indeed, it is envisaged that the tongues 3 may be also be rotated with respect to each other.

The operation of embodiments of the present invention will now be described with reference to the accompanying figures.

Figure 3:
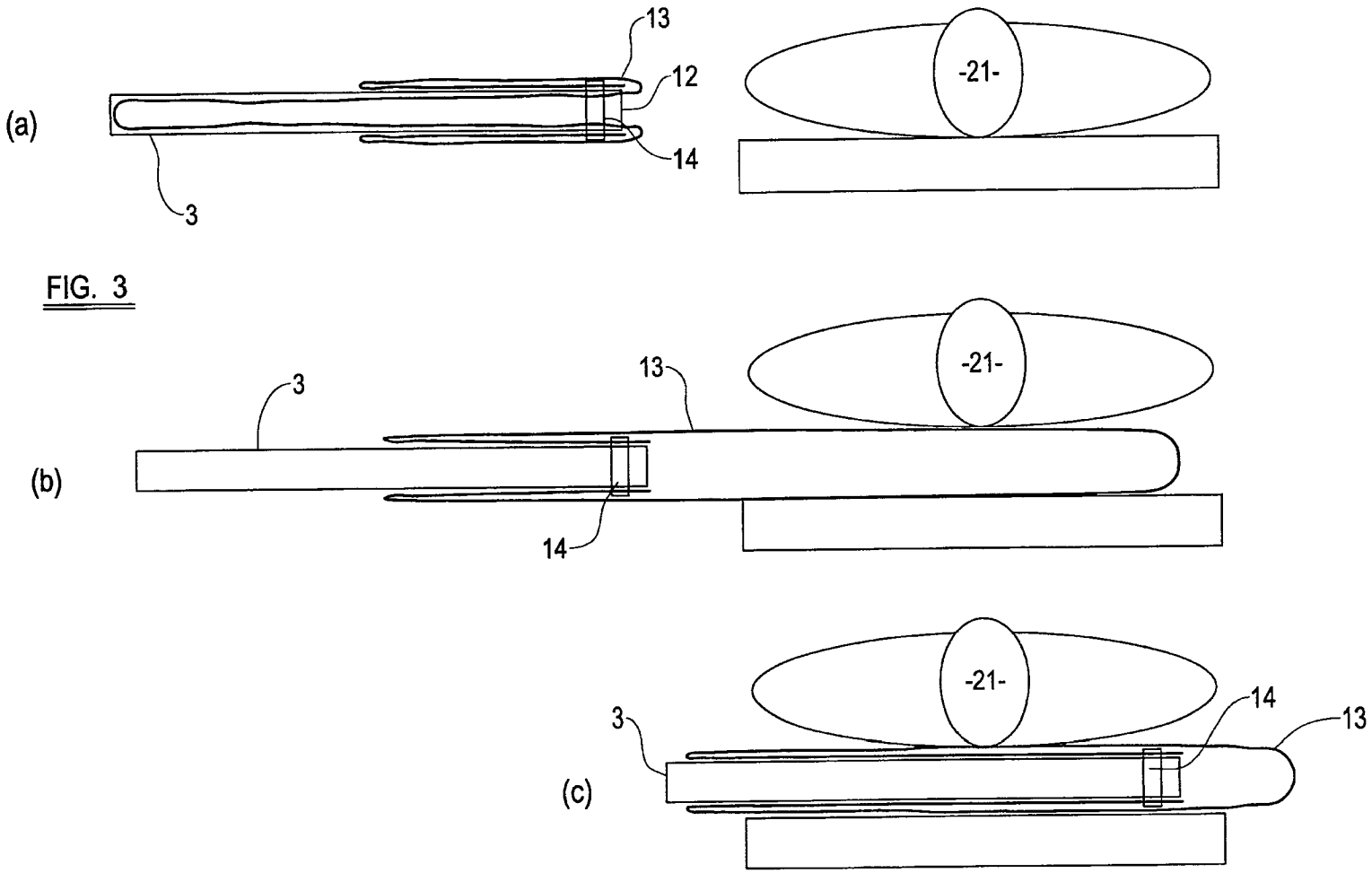
FIG. 3 shows an embodiment of the present invention in operation for collecting a patient.

FIG. 3 shows a first method of lifting a patient in accordance with an embodiment of the present invention, in which the sheath 13 on each tongue 3 is attached thereto at a fixed location.

The transfer trolley 10 is manoeuvred such that the arm 2 is generally parallel to a bed 20 on which a patient 21 is located (of course, the bed 20 could equally be manoeuvred such that it is generally parallel to the arm 2 of the transfer trolley). The height of the arm may be adjusted using the telescopically mounted turret 9 such that lower surfaces of the tongues 3 are generally level with an upper surface of the bed 20.

Initially, the sheaths 13 and tongues 3 are in the initial configuration, shown in FIG. 3*a*. Subsequently, the sheaths 13 are inflated by pumping air or another fluid into the FIGS. 3 using the compressor. As the sheaths 13 are inflated the portions of the sheaths that are contained within the tongues 3 move out of the hollow cavities 11 of the tongues 3. The sheaths 13 unfurl and are inflated, in a direction which is generally parallel to the tongues 3, and insinuate themselves under the patient 21. When the excess sheath material contained within the tongues has been inflated the double backed arrangement of the sheaths 13 on the tongues 3 may decrease in length of extension along the tongues 3 as the fold moves closer to the securing mechanism 14.

Once the sheaths 13 are in position under the patient 21 they can be fully inflated, thus lifting the patient 21 off the bed 20. If drawstrings 15 are utilised in the transfer trolley (as discussed above), then the spools and motors (or plungers) must allow the drawstrings 15 to be deployed so that the sheaths 13 can inflate. The sheaths 13 and tongues are now in a second configuration, shown in FIG. 3*b*.

Importantly, the sheaths 13 unfurl and evert under the patient 21 as they inflate. If operated correctly there is a little or no sliding of the sheaths 13 under the patient 21, which could damage open wounds (such are burns) or could drag bed linen across the bed 20 as the sheaths 13 inflate. Instead, the sheaths 13 insinuate under the patient 21.

The patient 21 is, in the second configuration of the trolley 10, supported on the inflated sheaths 13 which are, in turn, supported by the bed 20. The tongues 3 are then moved into the inflated sheaths 13 (see FIG. 3*c*). It will be appreciated that during this operation the tongues 3 will displace some of the air contained with in the sheaths 13. The compressor, therefore, includes a valve arrangement (not shown) to allow this air to escape without significantly decreasing the fluid pressure within the sheaths 13 (which should remain inflated until the tongues 3 are moved into a position such that they can support the weight of the patient 21). Alternatively, the valve may not be present and the fluid pressure in the sheaths 13 is simply allowed to increase. Once the tongues 3 are moved into a position such that they can support the weight of the patient, the sheaths 13 may be deflated (although, it will be appreciated that this is not necessary). The tongues 3 and sheaths 13 are now in a third configuration shown in FIG. 3*c*, and it will be appreciated that a second portion of the support surface of each tongue 3, which was not covered by the sheath 13 in the initial configuration is now covered thereby.

The tongues 3 can be moved into the sheaths 13 in a number of different manners; for example, the transfer trolley 10 can be moved towards the bed or, if the transfer trolley has a tower 8 mounted on a track (as described above), then the tower 8 can be driven along the track such that the tower 8, turret 9, arm 2 and tongues 3 all move towards the bed 20 but the base 4 remains in a substantially fixed location with respect to the bed 20.

Figure 4:
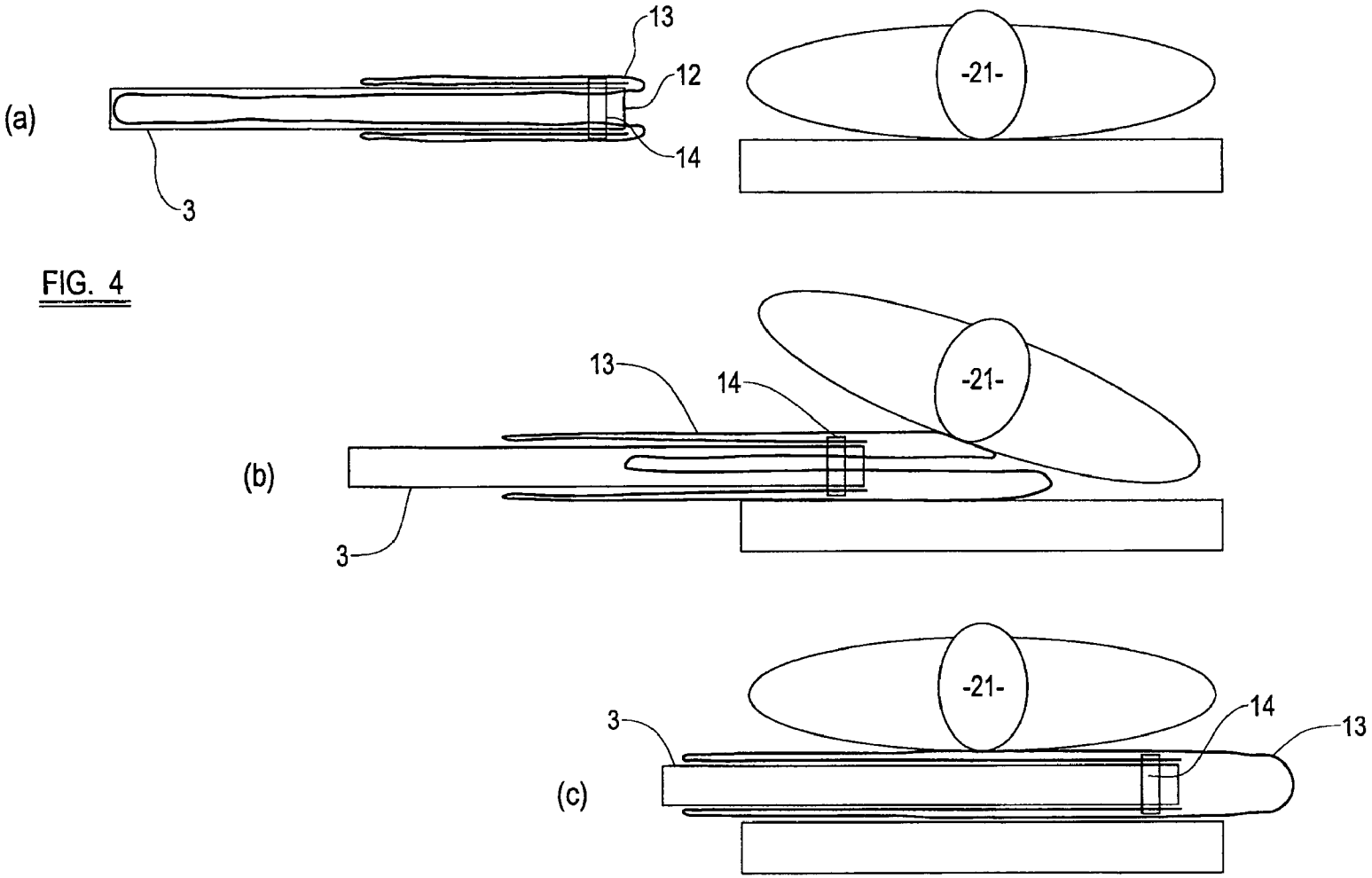
FIG. 4 shows the operation of another embodiment of the present invention for collecting a patient.

According to another aspect of the present invention there is a second method for collecting a patient which is shown in FIG. 4.

The operation of the transfer trolley 10, arm 2, and tongues 3, is generally similar to the first method described above, and at first the trolley 10 is in an identical initial configuration, shown in FIG. 4*a*. However, as the sheaths 13 are inflated the tongues 3 are contemporaneously moved towards the patient into the inflating cylinders formed by the sheaths 13 (see FIG. 4*b*). Specifically, the sheaths 13 inflate and unfurl under the patient 21. As the sheaths 13 inflate the tongues 3 are moved into the now inflated parts of the sheaths 13; it is not necessary to wait for the patient 21 to be entirely supported on the fully inflated sheaths 13 before the tongues 3 are manoeuvred into the partially inflated sheaths 13. In other words, the second configuration (as described above) is never reached. Instead, the movements necessary to achieve the third configuration are begun as the sheaths 13 inflate and the trolley 10 is placed in the third configuration without the intervening second configuration. As will be appreciated, the principle of operation of the second method is substantially similar to the first method; however, in some instances the second method can be utilised to lift a patient 21 from their bed 20 (see FIG. 4*c*) in less time than would be possible by simply using the first method.

Figure 5:
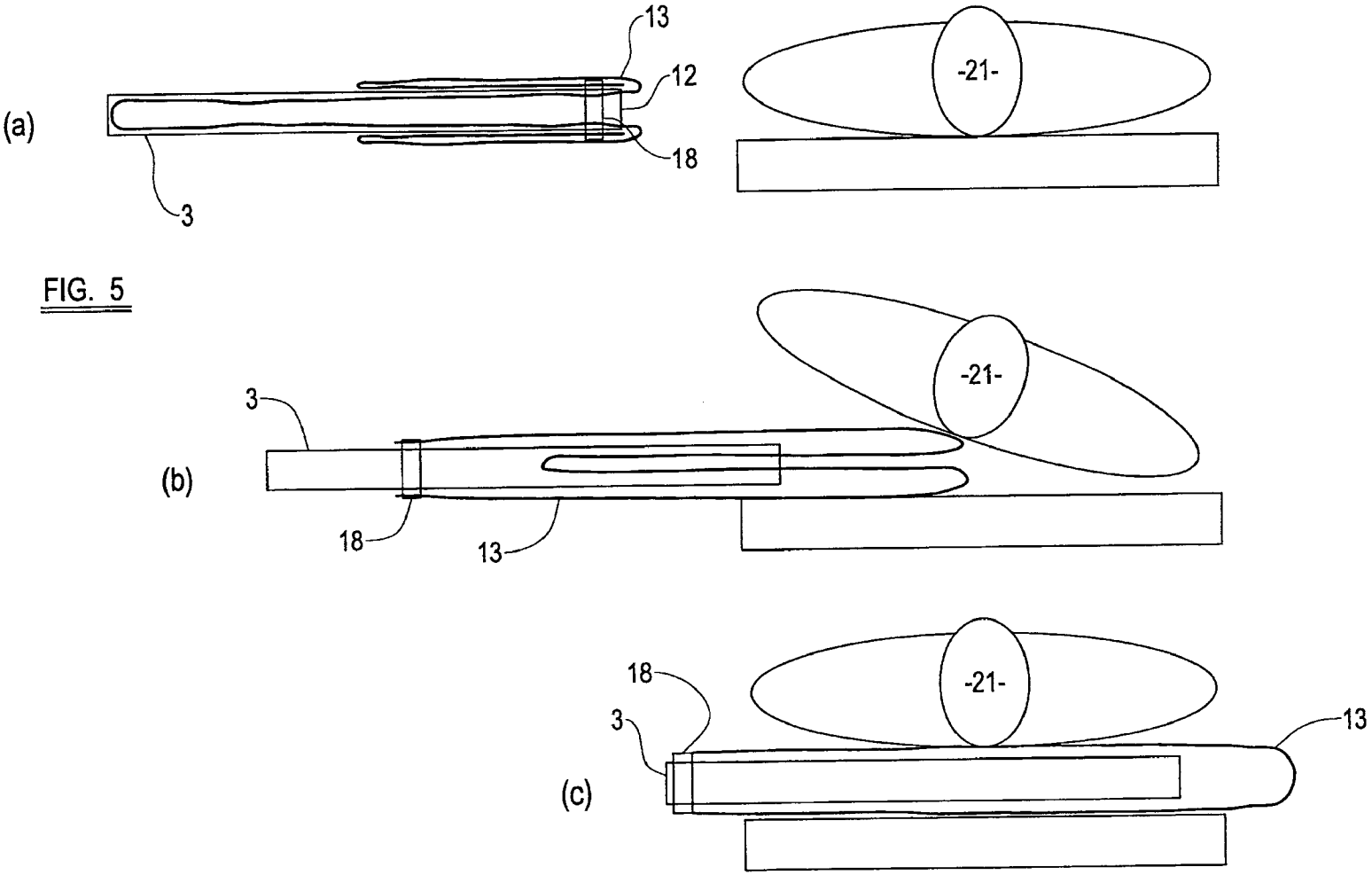
FIG. 5 shows the operation of another embodiment of the present invention for collecting a patient.

A third method of collecting a patient 21 according to an embodiment of the present invention is shown in FIG. 5. The third method requires sliding seals 18 to be used to attach the open ends of the sheaths 13 to the outer surfaces of the tongues 3 (as described above). The sheaths 13 are inflated in the same manner as described above in relation to the first method. However, contemporaneously, the sliding seals are slid along the tongues 3 towards the arm 2. In addition, the tongues 3 are moved into the inflating sheaths 13 towards the patient 21 (see FIG. 4*b*). Thus, it is possible to lift the patient 21 from the bed 20. In some instances the third method can be utilised to lift a patient 21 from a bed 20 in less time than is possible using the first or second methods.

It will be understood that the sheaths 13 may be fully insinuated under the patient 21 before the sliding seals 18 are slid towards the arm 2, and that it is not necessary to slide the seals 18 towards the arm before this.

In other words, the trolley 10 is arranged in the initial configuration (as described above) and the third configuration is achieved not only by inflating the sheaths 13 and moving the tongues 3 towards the patient (into the inflated sheaths 13) but the sheaths 13 are also effectively drawn down the length of the tongues 3 by the sliding seals 18. In this operation the seals 18 are generally held in place with respect to the sheaths 13 by abutment against the patient's bed 20. Preferably, there are end stops which prevent the seals from moving beyond the ends of the tongues 3.

It will be understood that in an embodiment of the present invention which utilises sliding seals 18, substantially all of the sheath 13 on each tongue 3 may be initially within the cavity 11 of the tongue 3. In other words, the doubled back sheath arrangement previously described is not necessary.

In summary, the first two methods of collecting a patient 21 require the sheaths 13 to be insinuated beneath the patient 21. The tongues 3 are then moved relative to the sheaths 13 such that the sheaths 13 roll back on their respective tongues 3 to cover a previously uncovered part thereof. The patient 21, therefore, moves so that he/she is are supported (at least partially) by the tongues 3. In the third method, the "rolling back" is not required because the sliding seal 18 moves along the tongue 3 towards the arm 2.

Figure 6:
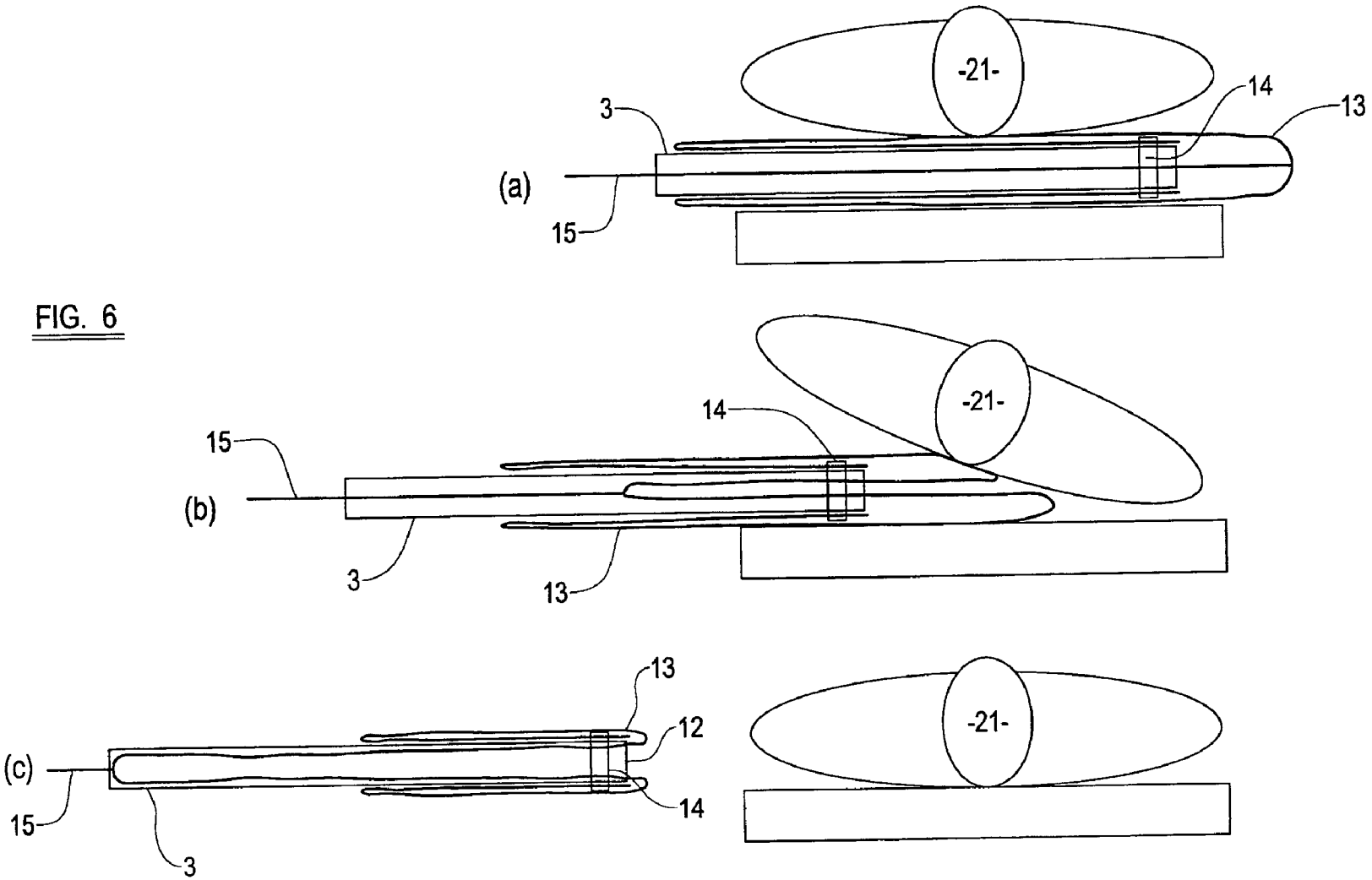
FIG. 6 shows the operation of an embodiment of the present invention for off-loading a patient.

A first method for offloading a patient from the transfer trolley 10 onto a bed 20 is shown in FIG. 6.

The transfer trolley 10 begins the offloading process in a configuration which is generally identical to the third configuration described above in relation to the patient collecting process. In particular, the patient is supported on the tongues 3 of the transfer trolley 10 and the sheaths 13 remain inflated with the tongues 3 located within the sheaths 13. The transfer trolley is manoeuvred with respect to a bed 20 such that lower surfaces of the tongues 3 are positioned above and adjacent to the upper surface of the bed 20.

In a second offloading configuration of the trolley 10 the drawstrings 15 are utilised to draw a portion of the sheaths 13 into the hollow cavities 11 of their respective tongues 3. The sheaths 13 are sufficiently inflated to ensure that as the portion of the sheaths 13 are drawn into the tongues 3, inflated portions of the sheaths 13 form cylinders (see FIG. 6*b*).

As a portion of each respective sheath 13 is drawn into its tongue 3, the tongues 3 are retracted from beneath the patient. Thus, the patient is at least partially supported by the cylinders formed by the inflated sheaths 13. The portion of each sheath 13 which is drawn into its respective tongue 3 is increased such that the inflated cylinders of the sheaths 13 decrease in size. Thus, the patient 21 is gently lowered onto the bed 20 by the sheath 13 as it rolls into the tongue 3. The tongues 3 can be moved away from the bed 20 in a number of different manners; for example, the transfer trolley 10 can be moved away from the bed or, if the transfer trolley has a tower 8 mounted on a track (as described above), then the tower 8 can be driven along the track such that the tower 8, turret 9, arm 2 and tongues 3 all move away from the bed 20 but the base 4 remains in a substantially fixed location with respect to the bed 20.

When the operation is complete (see FIG. 6*c*) the transfer trolley 10 is in a third offloading configuration which is generally identical to the initial configuration described above in relation to the collection of a patient.

Figure 7:
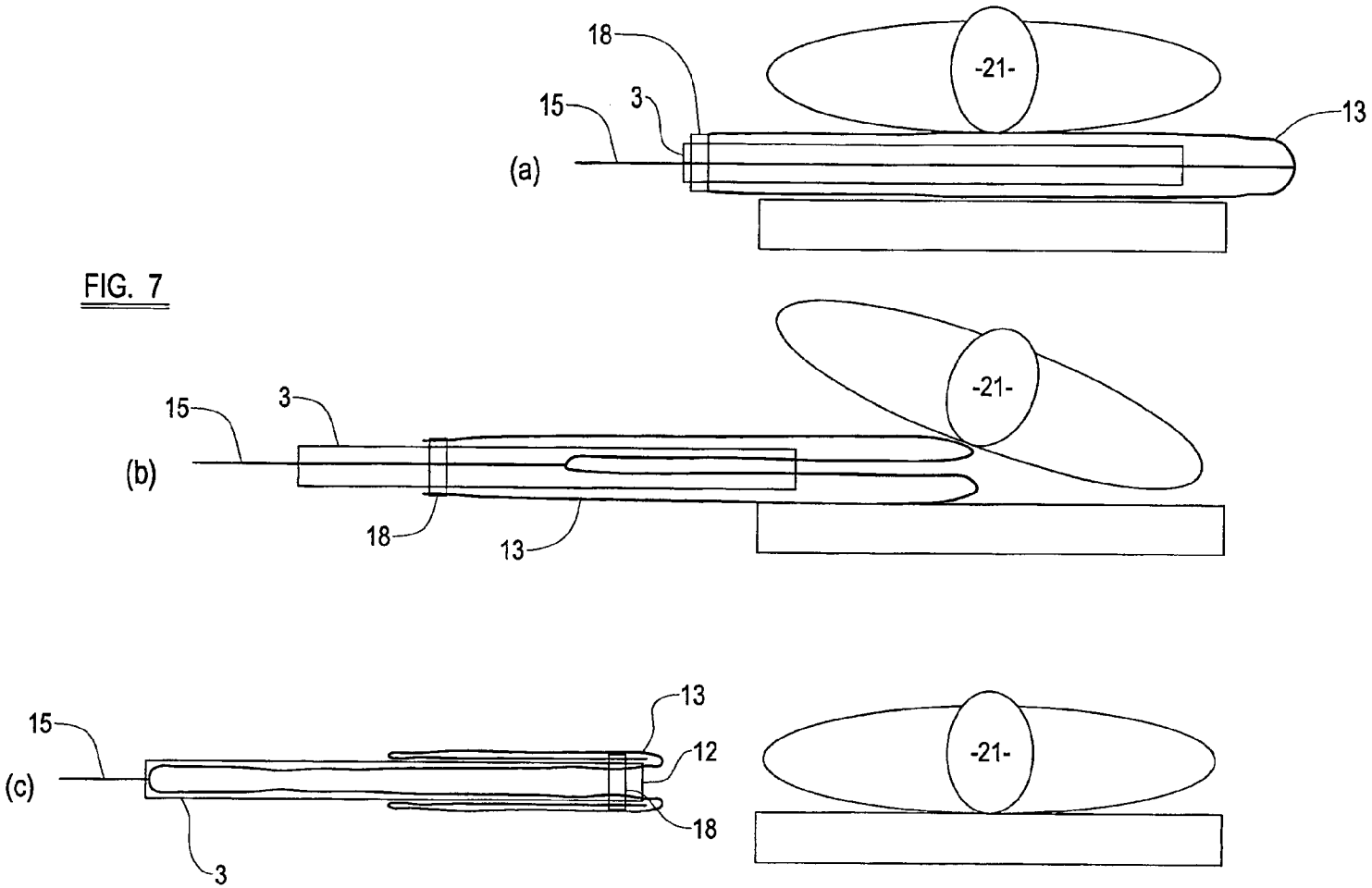
FIG. 7 shows the operation of another embodiment of the present invention for off-loading a patient.

A second method of offloading a patient in accordance with an embodiment of the present invention is shown in FIG. 7. The second method utilises an embodiment of the transfer trolley 10 of the present invention which includes sliding seals 18.

The method begins with a patient located on the transfer trolley 10 in a first offloading configuration which is substantially identical to the third collecting configuration described above in relation to the third collecting method.

In the second offloading method, a drawstring 15 is attached to each of the sheaths 13. As in the first method described above, a portion of each sheath 13 is drawn into its respective tongue 3 by the drawstring 15. However, unlike the first method described above, the sliding seal 18 (which is not present in the embodiment of the transfer trolley 10 utilised in the first method) on each tongue 3 is moved from a position which is close to the proximal end of the tongue 3 towards the distal end thereof. Movement of the sliding seals 18 may be achieved by movement of the tongues 3 with respect to, for example, to a bed 20 on which a patient 21 is located—the seals 18 being abutted against, and generally prevented from moving, by the bed 20.

Once again, the sheaths 13 form cylinders (as drawstrings 15 draw the excess sheath material into the hollow cavities 11 of the tongues 3) which partially support the weight of the patient 21 as the patient 21 is lowered to the bed 20. The cylinder formed by the sheath 13 steadily decrease in size as the sheaths 13 are drawn back into their respective tongues 3.

As an alternative to utilizing the drawstrings 15 (either driven by spools and motors, or plungers), it is also envisaged that the same effect may be achieve by reducing the fluid pressure in the hollow cavities 11 of the tongues 3. This will cause the excess sheath material to be effectively sucked back into the tongues 3.

Although it has been assumed above that all of the tongues 3 operate contemporaneously, it is envisaged that selective operation of some tongues 3 in advance of others may be achieved through the use of valves associated with each tongue 3.

The operation of embodiments of the present invention may utilise a computer (not shown), microcontroller (not shown) or other electronic circuitry (not shown) to control the operation of the transfer trolley 10, including the wheels or casters 17, any track, any valves associated with the trolley 10, and the mechanism utilised to raise and lower the turret 9.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

We claim:

1. A lifting element for use with a transfer trolley, the element comprising:

a support member having a support surface and a sheath attached to the support member such that, in an initial configuration, a first portion of the support surface is covered by the sheath and a second portion thereof is uncovered, wherein the sheath is operable to be inflated so as to cause the sheath to extend and evert, insinuating itself under a load in order to support the load, and, after inflation, the support member and the sheath may be moved with respect to each other so that the support member extends further into the sheath, the second portion of the support surface is covered by the sheath and the support surface at least partially supports the load.

2. A lifting element according to claim 1, wherein the sheath is fixedly attached to the main body section.

3. A lifting element according to claim 2, wherein:

the support member has a distal end and a proximal end;

the sheath is attached to the support member at a securing location which is separated from the proximal end of the member; and, after inflation, the support member and sleeve may be moved with respect to each other so that a portion of the sleeve covers at least a part of the region of the support surface between the securing location and the proximal end of the support member.

4. A lifting element according to claim 1, wherein the sheath is attached to the main body section by a sliding seal attachment arrangement.

5. A lifting element according to claim 4, wherein:

the support member has a distal end and a proximal end;

the sheath is attached to the support member by a sliding seal which is provided between the proximal and distal ends thereof and operable to slide along at least a part of the length of the member; and, after inflation, the sliding seal is operable to slide towards the proximal end of the member to allow the load to be at least partially supported by the support member.

6. A lifting element according to claim 1, further comprising a fluid channel to inflate the sheath.

7. A lifting element according to claim 6, wherein the fluid channel is provided within the support element.

8. A lifting element according to claim 1, further comprising a drawstring attached to the sheath and operable to control an aspect of the inflation or deflation of the sheath.

9. A transfer trolley including one or more lifting elements, wherein the or each lifting element comprises: a support member having a support surface and a sheath attached to the support member such that, in an initial configuration, a first portion of the support surface is covered by the sheath and a second portion thereof is uncovered, wherein the sheath is operable to be inflated so as to cause the sheath to extend and evert, insinuating itself under a load in order to support the load, and, after inflation, the support member and the sheath may be moved with respect to each other so that the support member extends further into the sheath, the second portion of the support surface is covered by the sheath and the support surface at least partially supports the load.

10. A transfer trolley according to claim 9, wherein the lifting elements are provided in spaced apart relation to provide an array on which a patient may be placed.

11. A transfer trolley according to claim 9, further comprising an arrangement for selectively controlling the one or more lifting elements.

12. A transfer trolley according to claim 9, further comprising a base arrangement including a track and a tower mounted on the track operable to support the one or more lifting elements, wherein the one or more lifting elements can be moved with respect to the base arrangement by moving the tower along the track.

13. A transfer trolley according to claim 9, wherein the lifting elements are supported by one or more arms.

14. A transfer trolley according to claim 13, wherein the lifting elements are supported by a plurality of arms.

15. A transfer trolley according to claim 14 wherein two or more of the plurality of arms are attached to each other by joints.

16. A transfer trolley according to claim 14, wherein the arms are operable to be moved with respect to each other.

17. A transfer trolley according to claim 9, further comprising an angle adjustment arrangement operable to adjust the angle of the lifting elements with respect to a horizontal plane.

18. A transfer trolley according to claim 9, wherein the lifting elements may be rotated with respect to each other.

19. A method of lifting a load utilizing a lifting element having a sheath and a support member comprising the steps of:

inflating the sheath causing the sheath to insinuate under the load, and moving the sheath and the support member with respect to each other so that the support member extends into the sheath and the support member at least partially supports the load, wherein:

the lifting element is for use with a transfer trolley, the support member has a support surface, and the sheath is attached to the support member such that, in an initial configuration, a first portion of the support surface is covered by the sheath and a second portion thereof is uncovered, the sheath being operable to be inflated so as to cause the sheath to extend and evert, insinuating itself under the load in order to support the load, and, after inflation, the support member and the sheath may be moved with respect to each other so that the support member extends further into the sheath, the second portion of the support surface is covered by the sheath and the support surface at least partially supports the load.

* * * * *